United States Patent [19]

Fox et al.

[11] Patent Number: 4,772,404

[45] Date of Patent: Sep. 20, 1988

[54] CONCENTRATED LIQUID FABRIC SOFTENER WITH WHITENERS

[75] Inventors: Daniel J. Fox, Hawthorne; Mary E. Sullivan, Lodi; Anthony J. Cuomo, North Bergen, all of N.J.

[73] Assignee: Lever Brothers Company, New York, N.Y.

[21] Appl. No.: 946,559

[22] Filed: Dec. 24, 1986

[51] Int. Cl.[4] ..... D06M 11/00; D06M 13/38; D06L 3/12

[52] U.S. Cl. ..... 252/8.8; 252/8.75; 252/8.9; 8/648; 8/188

[58] Field of Search ..... 252/8.75, 8.8, 8.9; 8/648

[56] References Cited

U.S. PATENT DOCUMENTS

| | | | |
|---|---|---|---|
| 3,904,533 | 9/1975 | Neiditch et al. | 252/8.75 |
| 4,134,840 | 1/1979 | Minegishi et al. | 252/8.75 |
| 4,439,335 | 3/1984 | Burns | 252/8.75 |
| 4,460,485 | 7/1984 | Rapisarda et al. | 252/8.75 |
| 4,497,718 | 2/1985 | Neiditch et al. | 252/8.75 |
| 4,562,002 | 12/1985 | Neiditch et al. | 252/8.75 |
| 4,654,152 | 3/1987 | Cukier et al. | 252/8.8 |
| 4,661,269 | 4/1987 | Trinh et al. | 252/8.8 |
| 4,675,022 | 6/1987 | Danner | 8/115.56 |

*Primary Examiner*—A. Lionel Clingman

*Attorney, Agent, or Firm*—James J. Farrell; Gerard J. McGowan

[57] ABSTRACT

A concentrated fabric softener having a dual cationic high active system, a sufficient level of fluorescent dye to whiten cotton garments, and a non-ionizing base. The dual active system is included at levels of greater than about 10% and preferably comprises a difatty amido ammonium methyl sulfate and a ditallow dimethyl ammonium chloride in a ratio of at least 1.5:1. Use of the concentrated softener results in reduced container size and greater manufacturing efficiencies. Inclusion of fluorescent dye restores whiteness/brightness to cotton garments yellowed by age.

13 Claims, No Drawings

CONCENTRATED LIQUID FABRIC SOFTENER WITH WHITENERS

BACKGROUND OF THE INVENTION

Liquid rinse cycle fabric softeners are used to provide a softened feel to garments that have become harsh during the washing process. Most commercially available fabric softeners use tallow-based quaternary actives which deposit onto the garment to provide a soft tactile feel. Unfortunately, the type of quaternary actives that provide softening in the rinse cycle can also leave a yellowish cast on the fabrics. Furthermore, the quaternary can "quench" the fluorescent whitening provided by fluorescent whitening agents (FWA) in the detergent. This tends to reduce the overall whiteness/brightness of the clothing and can leave laundry looking old and dingy. The addition in the fabric softener of a fluorescent whitening agent of the type commercially available for use in laundry products (such as the diamino-stilbene cyanuric chloride derivatives) acts to restore the whiteness/brightness of the garments' appearance that has been lost by the deposition of the softener actives.

Liquid rinse cycle fabric softeners have been commercially available for some time, with consumer usage in excess of 600 million lbs. The major commercial products for many years were aqueous emulsions containing from 3 to 8% by weight of one or more cationic actives. In the last several years, both in the United States and in Europe, higher active level liquid fabric softeners have become an active force in the marketplace. The high active level products (usually greater then 10% active level) provide a convenience to consumers in that they allow for a smaller dosage level to be used to deliver the same softening and antistatic benefits. This permits use of smaller, lighter packages that do the same number of washloads as larger containers of the lower active products. What has not been available to date has been a high active fabric softener that also provides a whitening benefit to the washload. This whitening benefit acts to counteract the yellowing noticed as clothing ages and also restores some of the whitening normally provided by the detergent that is quenched by the deposition of the cationic softener.

While it is desirable to include both softening and whitening agents in a liquid rinse cycle softener, it has proved to be difficult to keep the resultant product viscosity-stable and temperature-stable over the expected lifetime of the product. The stability problems in standard active level (4 to 7%) liquid rinse cycle softeners were overcome as described in Neiditch, et al. U.S. Pat. No. 4,497,718 by use of a non-ionizing base to neutralize the acid form of the fluorescent whitening agent, which permitted the FWA to be solubilized without inclusion of excess electrolyte which acts to reduce the stability of the product. The stability problems become even more difficult in the high active level (>10%) liquid fabric softeners. Softeners containing quaternary actives at high levels become very susceptible to thickening or gelling at low temperature (below 40° F.) storage. The presence of even low levels of electrolyte result in flocculation of the quaternary actives at low temperatures since these can coalesce and gel even though the product is above the freezing point.

The Neiditch, et al. patent (U.S. Pat. No. 4,497,718), mentioned above, describes a liquid fabric softener containing a fluorescent whitening agent complexed with a non-ionizing base of the type used in our invention. Neiditch, et al, teaches the use of these materials in a low active softener system (below 10% active) and does not include the use of Varisoft 222 softener or the like in conjunction with the standard ditallow ammonium chloride active. Burns (U.S. Pat. No. 4,439,335) describes a high active liquid fabric softener that contains both the type of softener in Varisoft 222 and the ditallow ammonium chloride softener. Burns, however, does not include fluorescent whitening agents or non-ionizing base. Burns does not indicate that FWA and non-ionizing base should be used and certainly fails to teach any criticality of the ratio of the two actives when they are combined with a fluorescent whitening agent and non-ionizing base.

SUMMARY OF THE INVENTION

We have discovered that the use of specific ratios of certain cationic surfactants in a dual quaternary active system permits the stable inclusion of a fluorescent whitening agent into a high active product containing a useful amount of the very effective ditallow dilower alkyl ammonium chlorides. It is the successful incorporation of these two desirable materials (i.e., the ditallow quaternary softener active along with the fluorescent whitening agent) into a stable high active liquid fabric softener that provides the basis for our invention.

None of the systems reviewed in the literature appears to contain the necessary combination of the critical ratio of the two actives along with the inclusion of a fluorescent whitening agent and non-ionizing base to produce a high active liquid fabric softener that is both stable and effective in use.

The fabric softener system of the invention is a dual quaternary high active system, i.e. a system containing an active level between 10 and 20%, which includes the acid or salt form, preferably the acid form, of a fluorescent whitening agent and a non-ionizing base in a stable suspension. The dual quanternary active comprises a Type 2 surfactant as defined below, such as ditallow, dimethyl ammonium chloride for example Adogen 442 (Sherex Chemical, Dublin, Ohio) or Arquad 2HT (Akzo Chemie America, McCook, Ill.) and a Type 1 surfactant as defined below, such as methyl bis (fatty alkyl aminoethyl) 2 hydroxyethyl ammonium methyl sulfate, e.g., Varisoft 222 (Sherex Chemical). These two quaternary actives are used in a ratio of at least 1.5:1 or greater of the Type 1 surfactant to the Type 2 surfactant at a total active level of from about 10 to 20%.

In addition to softener actives, other components can be added to enhance static reduction properties, provide for better dispersibility, improve freeze/thaw stability or brighten clothing. Additional adjuvants such as perfumes, germicides, bluing agents and pH adjusting agents are often added in small quantities.

The use of a dual quanternary active system in the ratios described herein is important to the production of a stable, effective high active liquid fabric softener that contains a useful amount of a fluorescent whitening agent. High active liquid fabric softeners containing effective amounts of an FWA that are formulated outside the ratio limit of the quaternary actives described above are unstable and thicken or gel at low temperatures. It is only within this critical ratio range of mixtures of the dual quaternary active systems that an effective, stable, FWA-containing liquid fabric softener as described herein can be formulated. While a dual quaternary active system is preferred at least minor amounts of other quaternary actives may be added.

DETAILED DESCRIPTION OF THE INVENTION

The fabric softening and whitening compositions of this invention contain the following components either as essential components or as optional ingredients: cationic surfactants for softening/antistatic benefits, viscosity control salts, bluing agents and colorants, fluorescent whitening agents, dispersing agents, organic acids for pH control, non-ionizable bases, perfumes and preservatives. Each of these components, both essential and optional, is discussed in greater detail as follows:

Cationic Surfactants

The cationic surfactants used in this invention are compounds of the following types:

Type 1 Surfactant

The Type 1 surfactant of the invention is a cationic softener selected from the group of surfactants having the following structure:

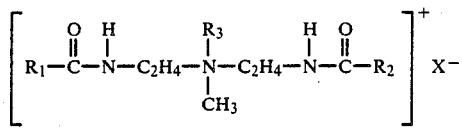

In this surfactant, $R_1$ and $R_2$ are the same or different from each other and are selected from the group consisting of $C_8$ to $C_{22}$ alkyl and alkenyl groups (often prepared from a tallow feedstock) and $R_3$ is selected from the group consisting of H, methyl, ethyl and $(C_nH_{2n}O)_xH$ wherein n is 2 or 3 and x is from 1 to about 5 and wherein $X^-$ is an anion, preferably selected from the group consisting of halides, sulfates, acetates and alkyl sulfates having from 1 to 3 carbon atoms in the alkyl chain. Examples of cationic surfactants of this description are those sold under the name Varisoft 222LM and Varisoft 222LT.

Type 2 Surfactant

The Type 2 surfactant is a cationic softener selected from the group of surfactants having the following structure:

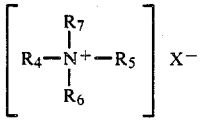

wherein $R_4$ and $R_5$ are the same or different from each other and are selected from the group consisting of $C_8$ to $C_{22}$ alkyl and alkenyl groups (often prepared from a tallow feedstock) and $R_6$ and $R_7$ are alkyl groups containing from one to three carbon atoms. X is an anion and is preferably selected from the group consisting of halides, sulfates, acetates and alkyl sulfates having from 1 to 3 carbon atoms in the alkyl chain. Examples of cationic surfactants of this description are those sold as Adogen 442 (ex Sherex Chemical) or Arquad 2HT (ex Akzo Chemie America).

In the compositions of the invention, surfactants of Type 1 are to be used at levels from about 6 to about 18%. Preferred levels of Type 1 surfactants are from about 9 to about 13%. Surfactants of Type 2 described in this invention are to be used at levels from about 1 to about 7%. Preferred levels of Type 2 surfactants are from about 2 to about 5%. In the composition of the invention, surfactants of Type 1 and Type 2 are both required to be used such that a ratio of from about at least 1.5:1 or greater of Type 1 to Type 2 surfactant is maintained. Preferred ratios of Type 1 to Type 2 surfactant are from 20:1 to 1.5:1 with a particularly preferred range of from 10:1 to 2:1 and a most preferred range of from 1.5:1 to 5:1.

Fluorescent Whitening Agents

Fluorescent whitening agents suitable for use with this invention are derivatives of stilbene sulfonic acid. Particularly preferred are 4,4'-bis[(4-phenylamino-6-N-bis(2-hydroxyethyl)amino-1,3,5-triazin-2-yl)amino]stilbene-2,2'-disulfonic acid available from Ciba Geigy (Ardsley, N.Y.) as Tinopal UNPA, the chemical structure of which is outlined as (I) below

FWA I

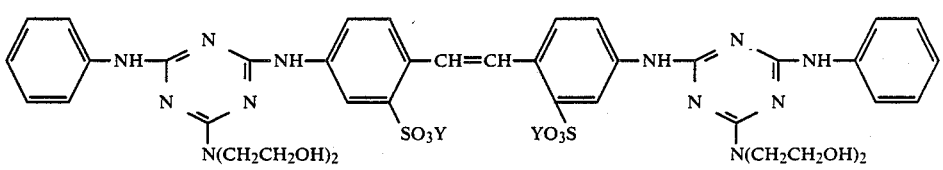

and 5-(2H-naphthol[1,2d]triazol-2-yl)-2-2'-phenylethenyl)benzene-sulfonic acid available from Ciba Geigy as Tinopal RBS, the chemical structure of which is outlined below as FWA II. In the formulas, Y is H or a cation.

FWA II

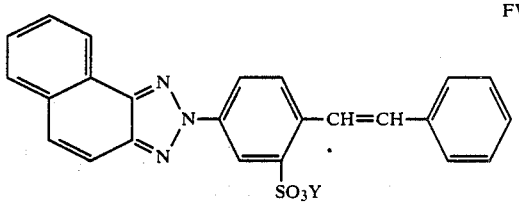

These fluorescent whitening agents may be present at a level from about 0.001% to about 1.0% by weight. Preferably, they should be present at a level from about 0.01% to about 0.6%.

Other preferred whitening agents include:

Phorwite BHC (hereinafter BHC) available from the Mobay Chemical Corporation, Union, N.J., which is 4,4'-bis(4-phenyl-1,2,3-triazol-2yl)-stilbene-2,2'-disulfonic acid disodium salt (FWA III, below)

FWA III

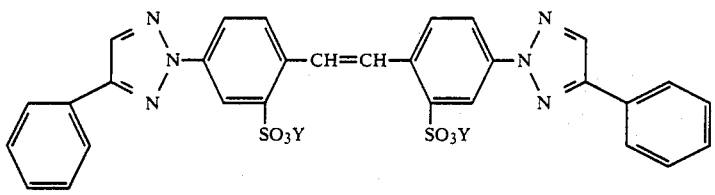

Tinopal 5BM (Ciba Geigy) which is 4,4'-bis(4-anilino-6-hydroxyethyl-methylamino-1,3,5-triazin-2-yl)amino stilbene-2,2'-disulfonic acid (FWA IV below).

FWA IV

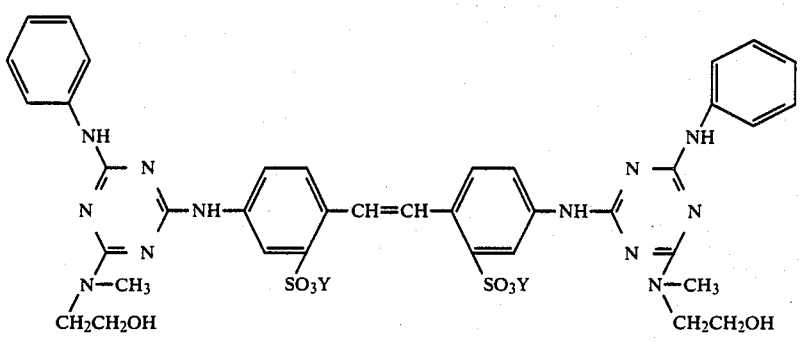

The main constituents of the DAS/CC type of fluorescent dyes are the 4,4'-bis[4-anilino-6-substituted-1,3,5-triazin-2-yl)amino]stilbene-2,2' disulfonic acids, or their alkali metal or alkanolamino salts, in which the substituted group is either morpholino, methylamino, dihydroxyethylamino, or hydroxyethylmethylamino as in I, above. The structure of the acid form is shown as FWA V.

FWA V

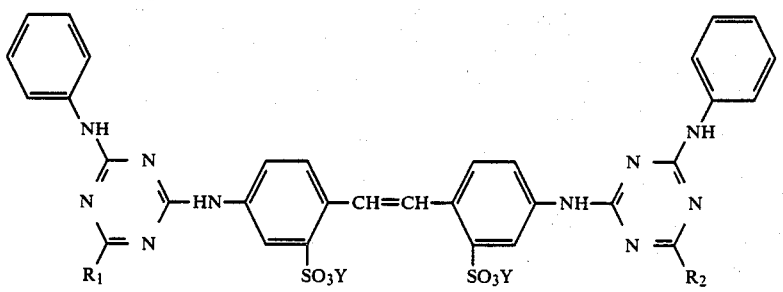

The fluorescent agents include those in which $R_1$ and $R_2$ are morpholino as in Tinopal AMS (ex Ciba Geigy), $R_1$ and $R_2$ are hydroxyethylmethylamino as in Tinopal 5BM (ex Ciba Geigy) (mentioned earlier) or $R_1$ and $R_2$ are dihydroxyethylamino as in Tinopal UNPA, also mentioned above. Other fluorescent whitening agents suitable for use in this invention include the naphthotriazolylstilbene type f.w.a.'s such as the salts of 5-(2H-naphtho[1,2-d]triazol-2-yl)-2-(2-phenylethenyl)-benzene sulfonic acid (e.g., II, above) or the diphenyltriazolylstilbene or distrylbiphenyl type fluorescent whiteners. The fluorescent whitening agents described above are used in amounts from about 0.001% to about 1% by weight of the total formula. Preferred fluorescent whitening agent use levels are from about 0.01% to about 0.6% and may involve use of either a single fluorescent whitener or a mixture of the fluorescent whiteners described above.

Non-Ionizable Bases

Non-ionizable bases suitable for use with this invention include those alkaline agents which do not ionize when dissolved in water. Typical examples of this type include ammonia, alkanolamines, pyridine, pyrrols, pyrrolidine, piperidine, piperazine, morpholine, alkylamines and other organic bases. Alkyl, alkenyl, aryl and alkylaryl derivatives of these nitrogen organic bases are suitable for use in this invention. For instance, triethylamine, diethylamine, ethylamine, propylamine and butylamine can be utilized.

Particularly preferred are the alkanolamines of structure $R_1R_2R_3N$ wherein $R_1$ is hydroxyalkyl and $R_2$ and $R_3$ are each selected from the group consisting of hydrogen and hydroxyalkyl. The alkyl group may contain from 1 to 24 carbons. Preferred alkanolamines are monoethanolamine, diethanolamine, triethanolamine and mixtures thereof.

Concentration levels for non-ionizable bases may vary from about 0.001% to about 0.5% by weight depending upon the molecular weight of the base and type and level of fluorescent whitening agent used. A preferred weight percent of non-ionizable base is from about 0.05% to about 0.3% when the base is triethanolamine and the fluorescent whitening agent is of the amino stilbene sulfonic acid type used at a weight percent of 0.1% to 0.6%.

pH Adjusting Agents

Sometimes it is desirable to use acidic components such as low levels of mineral acids or weak organic acids to adjust pH levels to between 3 to 6. Although such pH adjustment is not mandatory, it has been found beneficial in reducing bacterial contamination of the final product. Accordingly, acids such as citric acid, benzoic acid or other weak organic acids are often used for a pH adjustment. Typically, these materials are used at a level of between 0.01% and 0.3% when a pH of 3.0 to 6.0 is desired.

Dispersing Agents

Occasionally, dispersing agents are desirable in the fabric softener formula to aid in rapid dissolution of softener in the rinse water. While dispersing agent is not required, it is helpful. When included, the dispersing agent is usually an ethoxylated nonionic fatty alcohol or acid of chain length $C_{12}$–$C_{25}$ having from 3 to 12 units of ethylene oxide per carbon chain. Typically, dispersing agents are used at a level of between 0.1% and 1.0% when incorporated into these liquid fabric softener compositions.

Viscosity Control Salts

While it is necessary to restrain electrolyte level to maintain high viscosity, sometimes it is desirable to include very low levels of ionizable salts to fine-tune the viscosity level. To effect product viscosity reductions, it can be desirable to incorporate ionizable salts such as the salts derived from reacting mineral acids with strong bases. Typically, sodium or calcium chloride is used for this purpose at a level between 0.001% and 0.2%. Additional ionizable salts acceptable for this purpose include the sodium or potassium neutralized salts of organic acids such as citric or benzoic acids.

Minor Components

Other optional components common in use in fabric softeners may be added in small amounts to enhance either the appearance or performance properties of the liquid fabric softener compositions included in this invention. Typical components of this type include, but are not limited to colorants, bluing agents, preservatives, germicides and perfumes.

Preparation

The preferred preparation method of this softening system consists of a two mix process: the main mix, comprising water and water soluble components, is stirred and heated to about 155° F. The other mix is an organic permix which comprises: (1) the two active components (Type 1 and Type 2), (2) the fluorescent whitening agent, and (3) a non-ionizable base such as triethanolamine. The mixture is heated and stirred to a minimum of about 160° F. until all of the FWA is dispersed.

The organic permix is added to the main mix, with sufficient stirring to assure that the active does not collect on top of the water phase. Small amounts of salt are sometimes added as required at this stage to thin out the mixture to allow for thorough dispersal of the active phase. The resultant mixture is then cooled with stirring, at which point the perfume is added to complete the composition.

EXAMPLES 1-6

Storage stability tests were conducted on a series of products using a common base formula with the amounts of the Type 1 and Type 2 surfactants adjusted to meet the specified ratio. The total active level of Examples 1 through 4 is 15% while the active level of Examples 5 and 6 is 13.5%. The percentages referred to in the example formulas are by weight unless otherwise noted.

EXAMPLES 1-6

| COMPONENT | 1 | 2 | 3 | 4 | 5 | 6 |
|---|---|---|---|---|---|---|
| Type 1 Active (Varisoft 222 LM) | 15.0 | 13.0 | 11.0 | 8.0 | 0.70 | 0 |
| Type 2 Active (Adogen 442) | 0.0 | 2.0 | 4.0 | 7.0 | 12.8 | 13.5 |
| FWA (FWA I) | 0.432 | 0.432 | 0.432 | 0.432 | 0.432 | 0.432 |
| Triethanolamine | 0.151 | 0.151 | 0.151 | 0.151 | 0.151 | 0.151 |
| Citric Acid | 0.08 | 0.08 | 0.08 | 0.08 | 0.08 | 0.08 |
| Dyes, perfume, salt preservative | 0.7 | 0.7 | 0.7 | 0.7 | 0.7 | 0.7 |
| Deionized Water | | | to 100% | | | |
| Ratio: Type 1/ Type 2 | ∝ | 6.5 | 2.75 | 1.14 | 0.05 | 0 |

The example formulas (number 1-6) listed above were tested for storage stability. The storage testing consisted of placing samples of each example formula at temperatures of 125° F., 105° F., room temp (70°-75° F.), and 35° F. for periods of several months to simulate the storage a product would have to undergo in warehousing/distribution prior to sale. The results of these tests were as follows:

| Example Formula | Ratio Type 1:Type 2 | Storage Stability |
|---|---|---|
| 1 | ∝ | Acceptable |
| 2 | 6.5 | Acceptable |
| 3 | 2.75 | Acceptable |
| 4 | 1.14 | Unstable, thickens |
| 5 | .05 | Unstable, gels at 35° F. |
| 6 | 0.0 | Unstable, gels at 35° F. |

The storage data clearly shows the criticality of the minimum ratio of Type 1 to Type 2 active of 1.5:1 or greater. Products with ratios below 1.5:1 are unstable and thicken or gel especially at low storage temperatures. This instability problem is made more acute due to the presence of the fluorescent dye which acts to increase the electrolyte level of the system. Products made with ratios of active greater than 1.5:1 show good storage and acceptable softening with the softening improving as the ratio approaches 1.5:1 due to the increased level of Type 2 active. The formulation of a stable, efficient, high active level, FWA-containing liquid fabric softener has, therefore, been shown to be controlled by the ratio of the Type 1 to Type 2 active.

EXAMPLES 7-9

In Examples 7-9, alternate fluorescent whitening agents were used.

The preparation method of these batches was the same as that described above. A main mix consisting of the deionized water, citric acid, colorants, and the preservative was stirred and heated to 155° F. While the main mix was heating, the organic premix was prepared. The organic premix consisted of the fluorescent whitening agent, the nonionizable base, in this case triethanolamine, and the two surfactants. This permix was heated to about 165° F. and stirred until the FWA was completely dispersed.

After the FWA was dispersed the organic premix was added to the main mix, which was still stirring. Partial addition of the salt solution was made if needed to allow sufficient mixing of the system. The batch was then cooled to 120° F. and the perfume was then added and the batch weight brought to 100% with deionized water.

| | 7 | 8 | 9 |
|---|---|---|---|
| Citric Acid | 0.08 | 0.08 | 0.08 |
| Adogen 442 | 4.0 | 4.0 | 4.0 |
| Varisoft 222 LM-90% | 11.0 | 11.0 | 11.0 |
| Triethanolamine | 0.07 | 0.07 | 0.07 |
| FWA IV | — | 0.216 | — |
| BHC | 0.432 | — | — |
| FWA II | — | — | 0.216 |
| Fragrance, Colorants & Preservatives | 0.7 | 0.7 | 0.7 |
| $CaCl_2$ | 0.09 | 0.09 | 0.09 |
| Deionized $H_2O$ | to 100% | to 100% | to 100% |

The formulations of Examples 7-9 were found to be fluid, pourable liquids acceptable for use as concentrated fabric softeners which remained stable for over one month storage.

EXAMPLES 10-11

Examples 10 and 11 were prepared in accordance with the procedures of Examples 7-9. In examples 10 and 11, the following Type 1 surfactants were used respectively:

EXAMPLE 10

Varisoft (Sherex Chemical) 222 LT-90%=Methyl bis(oleylamidoethyl)2-hydroxyethyl ammonium methyl sulfate

EXAMPLE 11

Varisoft (Sherex Chemical) 238-90%=Methyl bis(-tallowamidoethyl)2-hydroxypropyl ammonium methyl sulfate

| | Alternate Type 1 Surfactant | |
|---|---|---|
| Raw Material | 10 | 11 |
| Citric Acid | 0.08 | 0.08 |
| Adogen 442 | 4.0 | 4.0 |
| Varisoft 222 LT-90% | 11.0 | — |
| Varisoft 238 | — | 11.0 |
| Triethanolamine | 0.151 | 0.151 |
| FWA I | 0.432 | 0.432 |
| Fragrance, Colorants & Preservatives | 0.7 | 0.7 |
| $CaCl_2$ | 0.09 | 0.09 |
| Deionized $H_2O$ | to 100% | to 100% |

The formulations of Examples 10-11 were found to be fluid, pourable liquids acceptable for use as concentrated fabric softeners and which remained stable over a one month storage period.

EXAMPLES 12 AND 13

In examples 12 and 13 the procedure followed for Examples 7-9 was used. The type II surfactants used in Examples 12 and 13 were, respectively.

Example 12

Adogen 462 (Sherex Chemical)=Dicoco dimethyl ammonium chloride

Example 13

Adogen 470 (Sherex Chemical)=Ditallow dimethyl ammonium chloride

| Raw Material | 12 | 13 |
|---|---|---|
| Citric Acid | 0.08 | 0.08 |
| Adogen 462 | 4.0 | — |
| Adogen 470 | — | 4.0 |
| Varisoft 222 LM-90% | 11.0 | 11.0 |
| Triethanolamine | 0.151 | 0.151 |
| FWA I | 0.432 | 0.432 |
| Fragrance, Colorant & Preservative | 0.7 | 0.7 |
| $CaCl_2$ | 0.09 | 0.09 |
| Deionized $H_2O$ | to 100% | to 100% |

The formulations of Examples 12 and 13 were found to be fluid, pourable liquids acceptable for use as concentrated fabric softeners and which remained stable over a one month period of storage.

The foregoing description and examples illustrate selected embodiments of the present invention. In light thereof, various modifications will be suggested to one skilled in the art all of which are within the spirit and purview of this invention.

We claim:

1. A liquid fabric softener comprising:

(a) from about 10 to about 20 percent by weight of a quaternary active system including a first cationic surfactant having the formula

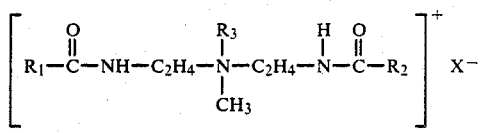

wherein $R_1$ and $R_2$ are the same or different and are selected from the group consisting of $C_8$ to $C_{22}$ alkyl and alkenyl groups and $R_3$ is selected from the group consisting of H, methyl, ethyl and $(C_nH_{2n}O)_xH$ wherein n is 2 or 3 and x is from 1 to about 5 and wherein $X^-$ is an anion, and a second cationic surfactant of the formula

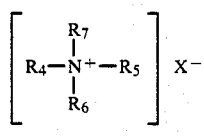

wherein $R_4$ and $R_5$ are the same or different and are selected from the group consisting of $C_8$ to $C_{22}$ alkyl and alkenyl and $R_6$ and $R_7$ are alkyl groups of from 1 to 3 carbon atoms and X is an anion, in a ratio of first to second surfactants of from at least 1.5:1, (b) a fluorescent whitening agent selected from the group consisting of (i) fluorescent dyes selected from the group consisting of (1) 4,4'bis[(4-phenylamino-6-N-bis(2-hydroxyethyl)amino-1,3,5-triazin-2-yl)amino]-stilbene-2,2'disulfonic acid, (2) 4,4'-bis(4-anilino-6-hydroxyethylmethylamino-1,3,5 triazin-2-yl)amino stilbene-2,2'disulfonic acid, (3) 4,4'-bis[(4-anilino-6-(morpholino)-1,3,5-triazin-2-yl)amino stilbene 2,2'disulfonic acid, (4) 4,4'-bis[(4-anilino-6-(methylamino)-1,3,5-triazin-2-yl)amino]stilene-2,2'disulfonic acid (ii) 5-(2H-napthol[1,2d]triazol-2-yl)-2-(2-phenylethenyl)-benzene-sulfonic acid (iii) 4,4'-bis(4-phenyl-1,2,3-triazol-2-yl)-stilbene-2,2'-disulfonic acid disodium salt or their alkali metal or ammonium salts and (c) a nonionizable base.

2. The liquid fabric softener of claim 1 wherein the first fabric softener is a methyl bis $C_8$–$C_{22}$ alkyl or alkenyl amidoethyl hydroxyethyl ammonium methyl sulfate.

3. The liquid fabric softener of claim 1 wherein the second fabric softener is a ditallow dimethyl ammonium chloride.

4. The liquid fabric softener of claim 1 wherein the ratio of first actives to second actives is between 20:1 and 1.5:1.

5. The liquid fabric softener of claim 1 wherein the ratio of first surfactant to second surfactant ratio is between 10:1 and 2:1.

6. The liquid fabric softener of claim 1 wherein the ratio of first actives to second actives is between 1.5:1 and 5:1.

7. The liquid fabric softener of claim 1 wherein the ratio of first actives to second actives is about 2.75:1.

8. The liquid fabric softener of claim 1 wherein the fluorescent whitening agent is 4,4'-bis[4phenylamino-6-N-bis(2-hydroxyethyl)amino-1,3,5-triazin-2-yl)amino]-stilbene-2,2'-disulfonic acid.

9. The liquid fabric softener of claim 1 wherein the fluorescent whitening agent is 4,4'bis[4-anilino-6-hydroxyethyl-methylamino-1,3,5-triazin-2-yl)]stilbene-2,2'-disulfonic acid.

10. The liquid fabric softener of claim 1 wherein $R_1$ is selected from the group consisting of $C_{16}$–$C_{18}$ alkyl and alkenyl groups.

11. The liquid fabric softener of claim 1 wherein $R_2$ is selected from the group consisting of $C_{16}$–$C_{18}$ alkyl and alkenyl groups.

12. The liquid fabric softener of claim 1 wherein the anion $X^-$ for the first and second surfactants are independently selected from the group consisting of halides, sulfates, acetates and alkyl sulfates having from 1 to 3 carbon atoms in the alkyl chain.

13. The liquid fabric softener of claim 1 wherein the cationic surfactants consist of first surfactant and second surfactants.

* * * * *